United States Patent [19]

Häussler

[11] 4,384,598

[45] May 24, 1983

[54] DEVICE FOR THE CONSTRAINED ACTUATION OF CLAMPING MEANS OF FILLING-YARN INSERTION MEANS IN SHUTTLELESS WEAVING MACHINES

[75] Inventor: Horst Häussler, Lindau, Fed. Rep. of Germany

[73] Assignee: Lindauer Dornier Gesellschaft mbH, Fed. Rep. of Germany

[21] Appl. No.: 180,581

[22] Filed: Aug. 25, 1980

[30] Foreign Application Priority Data

Aug. 25, 1979 [DE] Fed. Rep. of Germany ..... 2934474

[51] Int. Cl.[3] ..... D03D 47/18

[52] U.S. Cl. ..... 139/446

[58] Field of Search ..... 139/443, 444, 445, 446, 139/438

[56] References Cited

U.S. PATENT DOCUMENTS 1,805,046 5/1931 Menschner ..... 139/446

3,665,975 5/1972 Kokkinis ..... 139/446

*Primary Examiner*—Henry Jaudon

*Attorney, Agent, or Firm*—James E. Bryan

[57] ABSTRACT

This invention relates to an improvement in a device for the actuation of clamping means for filling yarn in a shuttleless weaving machine with filling yarn insertion by means of gripper systems advanced from both sides into the shed and then retracted and having clamping means for the filling yarn, said gripper systems actuating the clamping means in constrained manner through the intermediary of a control lever mounted on an arm secured to the sley shaft, pivotal therewith, and passing from the outside through the warp of the shed, the control lever being actuated by a cam, a swing lever with roller adapted to engage the cam, and a connecting rod connected to the swing lever and the control lever, the improvement comprising means pivotally mounting the swing lever on the weaving machine outside of the sley shaft.

1 Claim, 2 Drawing Figures

Figure 1:
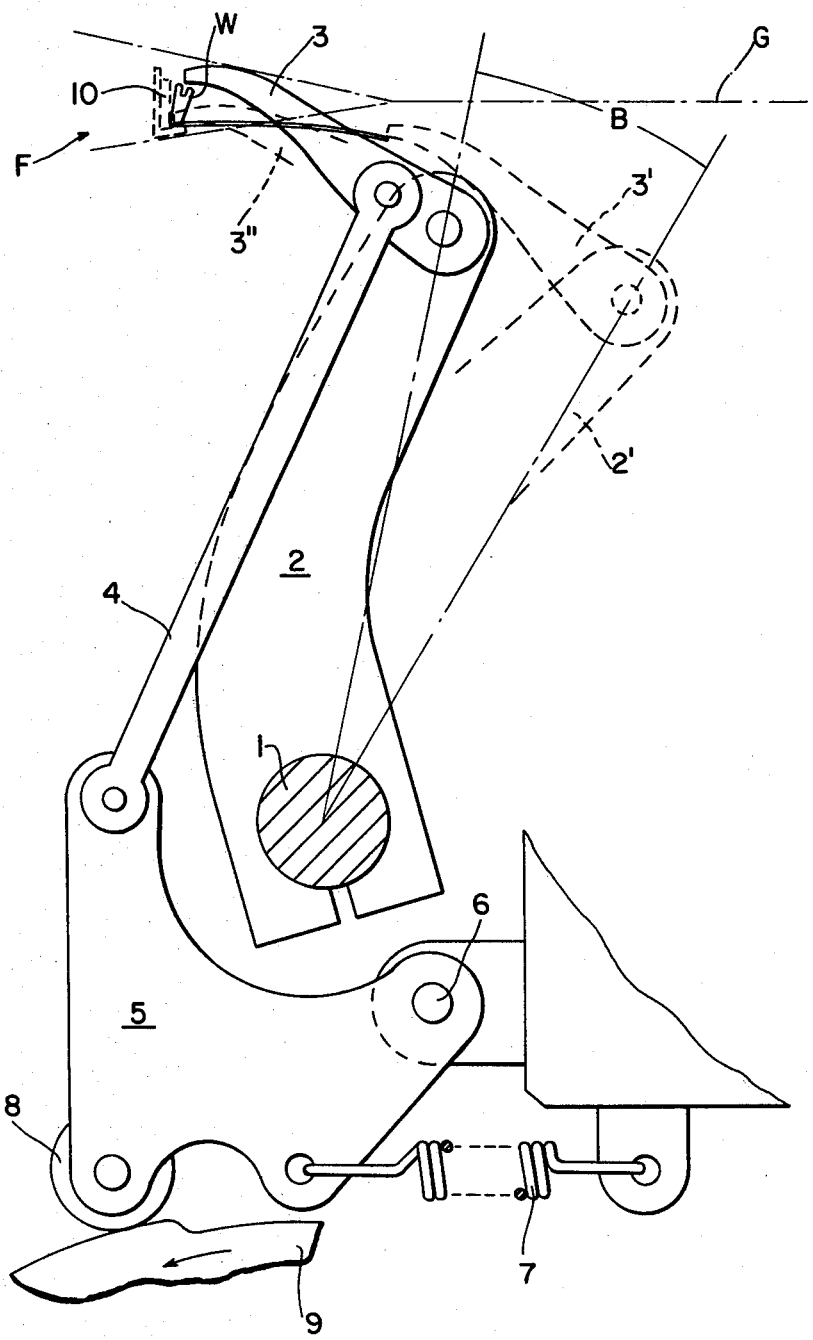

DEVICE FOR THE CONSTRAINED ACTUATION OF CLAMPING MEANS OF FILLING-YARN INSERTION MEANS IN SHUTTLELESS WEAVING MACHINES

The present invention relates to a device for shuttleless weaving machines with gripper systems advanced from both sides into the shed and then retracted, and with clamping means for the filling yarn. Provision is made in such a device for control levers that constrain the actuation of the clamping means, these levers passing from the outside through the warp yarns of the shed and being pivotally supported on arms solidly seated on the sley shaft. These control levers are controlled by a cam using a swing lever with rollers and a connection rod connected thereto.

A weaving machine with reciprocatingly inserted and retracted gripper rods entering approximately equally deep into the shed and with an above-cited device is known from German Pat. No. 1,710,292. In this machine, the filling yarn is seized by the clamping means of a gripper system outside the shed and is moved by the gripper approximately as far as the center of the shed. There, the filling yarn is transferred to the clamping means of a gripper system from the opposite side, which is being advanced, and upon the retraction of this gripper system is pulled completely through the shed. The yarn transfer at the center of the shed takes place by a constrained control of the involved clamping means in such a manner that control levers briefly pass from the outside through the warp yarns of the shed and open and then close the clamping means. The actuation of the control levers is coupled to the main drive of the weaving machine and takes place not only when there is yarn transfer at the center of the shed, but also may occur when seizing and again releasing the filling yarn outside the shed.

The control levers are pivotally supported on arms which in turn are fixed on the sley shaft. The control levers are actuated by a cam by means of a spring-loaded roll-lever pivotally supported on the sley shaft and using a crankrod. The axis of rotation of the roll or swing lever for actuating the control levers therefore coincides with the axis of rotation of the sley shaft. At reed beat-up, the above-cited arm not only carries along the control lever, but, further, it rotates the roll or swing lever by means of a stop and drive means, so that the sensing roller lifts off of the cam. The spacing between the stop and the drive means must be set accurately in order to obtain the proper motion of the control lever at reed beat-up.

Because of this design of the device, the rollers no longer cleanly make contact with or lift off of the cam contact surface at higher angular speeds of the weaving machine, rather tending to chatter. This means also that they undesirably will lift off the control or contact surface of the cam even when they should be making contact with it. As the control levers follow the roller motion through the connecting rod, spurious actuations of the clamping means at the gripper systems may occur. Then defect-free filling yarn transfer no longer will be assured from one gripper system to the other. Also, the rollers, by their chattering, greatly stress the cam contact surfaces, which in the end will be damaged thereby.

This being the state of the art, it is the object of the present invention to so improve the control of the clamping means at the gripper systems that even for high angular speeds of the weaving machine, defect-free transfer of filling yarn will be assured and damages to machine parts will be minimized.

This problem is solved by the invention in that the swing lever sensing the cam motion is pivotally supported outside the sley shaft so as to be fixed with respect to the weaving machine. In this design, the center of rotation of the roll or swing lever for driving the connecting rod and the control lever no longer is located in the sley shaft, and there no longer is a lift off from the cams by the rollers, rather the rollers always remain in contact with the control curve of the cam. Furthermore, the masses swinging to and fro with the rotational motion of the sley shaft now are less. Again, the previously required expensive accurate setting of the costly and highly stressed running surfaces at the stop and the drive means is now eliminated. In addition, a superior arrangement of the return spring at the swing lever is made possible, and no interfering inertial forces take place at the spring when there is reed beat-up. Lastly, smaller paths obtain for the motion of the control lever at reed beat-up, whereby the decrease in the inertial forces, in turn, allows increasing the angular speed of the weaving machine.

Figure 2:
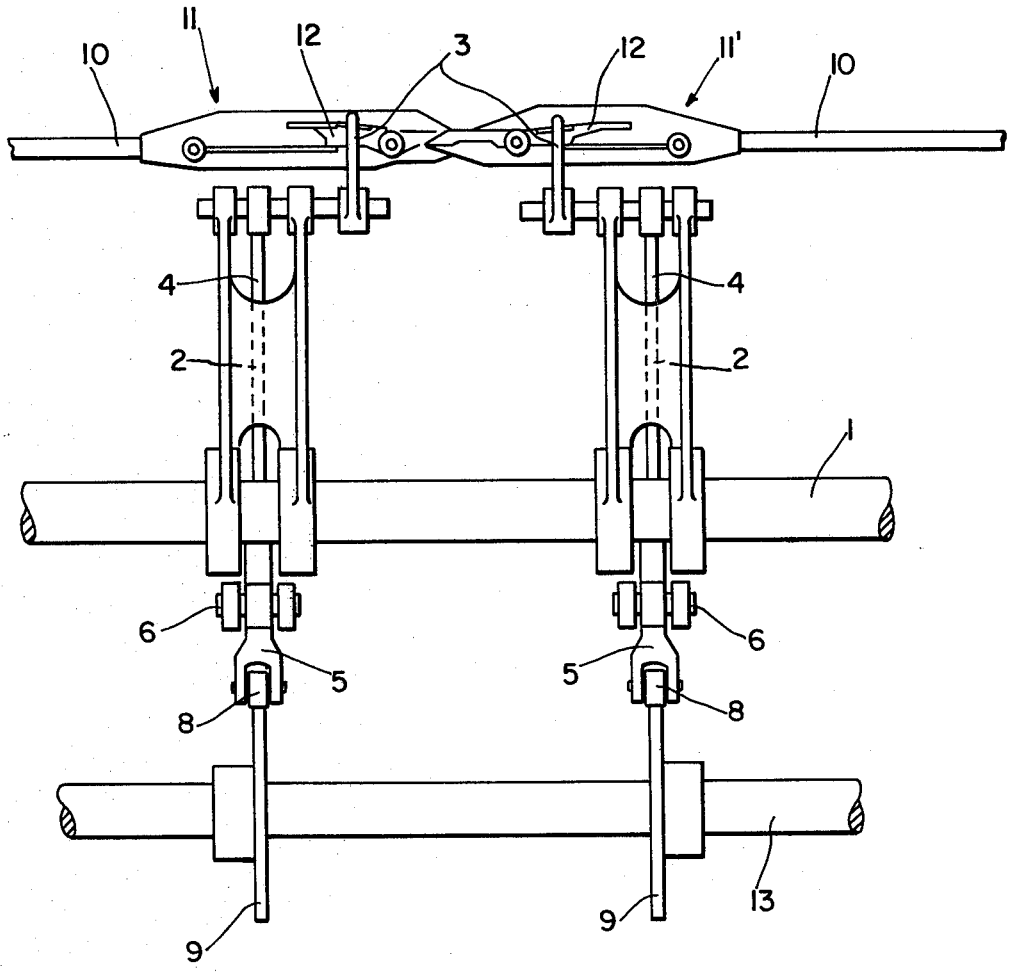

An embodiment of the invention is discussed below in relation to the accompanying drawing, in which FIG. 1 is a view in elevation of the control lever and its drive mechanism for a gripper system; and FIG. 2 shows the arrangement of the control means in the central region of a weaving machine, not shown in further detail, viewed from the side of the wares.

FIG. 1 of the drawing shows the control lever and its drive mechanism for a gripper system. Another device as such is required to control the matching gripper system, but is omitted for the sake of clarity. The sley shaft is denoted by 1. The arm 2 is secured on the shaft 1 so as to be secure against rotation, and at its end supports the control lever 3 in a rotatable manner. The swing lever 5 is pivotally supported by its bearing 6 so as to be fixed to the weaving machine. It is provided with a return spring 7. The sensing roller 8 supported by the swing lever 5 always rests against the cam 9 on account of the force of the return spring 7. The cam 9 and its direction of rotation are merely indicated. The connecting rod 4 represents the connection between the control rod 3 and the swing lever 5. The connecting rod transmits the swing motion from the control curve of the cam 9 to the control lever 3. The control lever 3 when in the position shown in solid lines penetrates the shed F shown in dot-dash lines. A gripper system 10 with the clamping system to be actuated is shown inside the shed in phantom.

The operation of the device when in operation now will be explained. The path of the tip of the control lever is indicated by the line W from the position shown by the solid lines of the control lever 3 in the shed F. To actuate the clamping means at the gripper system 10, that is to open the clamping means, the tip of the control lever 3 is slightly lowered and then raised again as shown by the indicated path of the control curve of the cam 9.

Presently, a filling yarn can be pulled out of the gripper system and be transferred to the matching gripper. The clamping means is closed again by again raising the tip and the transferred filling yarn is held in position in the accepting gripper. After the gripper system 10 in the ensuing process has left its indicated position at the center of the shed, the tip of the control lever is lowered further, into the position 3″. From there, the control lever is carried along at the reed beat-up by the pivoting motion of the arm 2 and brought into the position 3′ shown in phantom. The beat-up motion of the reed is indicated by the two dot-dash straight lines and the angle B. The arm seated on the sley shaft 1 then also assumes the position 2′ indicated again in dashed lines. During the beat-up motion, the control lever 3 furthermore undergoes an additional downward motion whereby damage at the fabric G during the beat-up motion will be averted. After the beat-up, the arm 2 together with the control lever 3 first is pivoted back, passing through the position 3″, and then is lifted back into the initial position 3. The control lever 3 in the process briefly enters the shed F and is ready for its function when the gripper system 10 again arrives at its transfer position.

FIG. 2 shows rigid gripper bars 10 advanced from both sides of the weaving machine toward the center thereof. These bars are provided at their tips with grippers 11 and 11′. The grippers essentially consist of two-arm clamping levers 12 holding the filling yarn to be inserted under spring tension. The filling yarn is moved, for instance by the left-hand gripper 11, roughly to the center of the shed and there it is to be transferred to the gripper 11′ which on its return motion will completely pull the filling yarn through the shed. The transfer of the yarn from the gripper 11 to the gripper 11′ requires external actuation of the clamping levers 12. This is implemented by the control levers 3. Each of the grippers 11 and 11′ is provided with one system shown in a side view in FIG. 1.

Pivotal arms 2 are non-rotatably secured to the sley shaft 1; in this instance double arms are assumed which are connected to each other by means of an intermediate leg in the form of a bail. A shaft, not shown in further detail, is rotatably supported on the end of the arms 2, and the control levers 3 are fixed to this shaft. The shaft with the control lever 3 can be rotated by the up-and-down motion of a coupling rod 4. The motion of the coupling means 4 is generated by the cams 9 which are mounted in a non-rotatable manner on a shaft 13 rotating always at uniform speed. Pivot levers 5 act as the intermediate member between the coupling means 4 and the cams 9. The fixed support of the pivot levers 5 is denoted by 6. The rollers 8 for sensing the cams 9 are mounted in fork-like parts of the pivot levers 5. The return spring 7 shown in FIG. 1 and acting on the pivot lever 5 is omitted from FIG. 2 for the sake of clarity.

It will be obvious to those skilled in the art that many modifications may be made within the scope of the present invention without departing from the spirit thereof, and the invention includes all such modifications.

What I claim is:

1. In a device for the actuation of clamping means for filling yarn in a shuttleless weaving machine with filling yarn insertion by means of gripper systems advanced from both sides into the shed and then retracted and having clamping means for the filling yarn, said gripper systems actuating the clamping means in constrained manner through the intermediary of a control lever mounted on an arm secured to the sley shaft, pivotal therewith, and passing from the outside through the warp of the shed, said control lever being actuated by a cam, a swing lever with roller adapted to engage said cam, and a connecting rod connected to said swing lever and said control lever, the improvement comprising means pivotally mounting said swing lever on said weaving machine outside of the sley shaft.

* * * * *